US011432588B1

(12) United States Patent
Santos

(10) Patent No.: US 11,432,588 B1
(45) Date of Patent: Sep. 6, 2022

(54) INDUCTION HEATED NECTAR COLLECTOR

(71) Applicant: Rodrigo Escorcio Santos, Rockville, MD (US)

(72) Inventor: Rodrigo Escorcio Santos, Rockville, MD (US)

( * ) Notice: Subject to any disclaimer, the term of this patent is extended or adjusted under 35 U.S.C. 154(b) by 0 days.

(21) Appl. No.: 17/487,338

(22) Filed: Sep. 28, 2021

(51) Int. Cl.

| | |
|---|---|
| ***A24F 13/00*** | (2006.01) |
| ***A24F 40/465*** | (2020.01) |
| ***A24F 40/10*** | (2020.01) |
| ***A24F 40/20*** | (2020.01) |
| ***A24F 40/57*** | (2020.01) |

(52) U.S. Cl.
CPC ..... *A24F 40/465* (2020.01); *A24F 40/10* (2020.01); *A24F 40/20* (2020.01); *A24F 40/57* (2020.01)

(58) Field of Classification Search
CPC ..... A24F 47/00
USPC ..... 131/328–329
See application file for complete search history.

(56) References Cited

U.S. PATENT DOCUMENTS

2020/0236998 A1* 7/2020 Batista ..... A24F 40/85

OTHER PUBLICATIONS

SMOKEA® 14mm Titanium Replacement Nail for Nectar Collectors, https://smokea.com/products/smokea-14mm-titanium-replacement-nail-for-nectar-collectors?variant=31065816897, Aug. 30, 2021, 8 pages.
Yocan the One Nectar Collector and Wax Kit, https://www.yocanusa.com/products/the-one-nectar-and-wax-kit-by-yocan, Aug. 30, 2021, 11 pages.

* cited by examiner

*Primary Examiner* — Phuong K Dinh
(74) *Attorney, Agent, or Firm* — Edell, Shapiro & Finnan, LLC

(57) ABSTRACT

A system and method for induction heating a vaporization device is disclosed. The system includes a pipe having an inlet and an outlet, a heating rod extending from a proximal end to a distal end and defining a fluid channel, and a heating assembly. The proximal end of the heating rod is configured to engage the inlet of the pipe and the fluid channel extends through at least a portion of the heating rod. The heating assembly includes a coil concentric with at least an induction portion of the heating rod and one or more electrical components configured to deliver power to the coil so that the coil can heat the heating rod through induction heating.

20 Claims, 7 Drawing Sheets

INDUCTION HEATED NECTAR COLLECTOR

FIELD OF INVENTION

The present invention relates to the field of vaporization devices and, in particular, a nectar collector system with an induction heating assembly that avoids contact of vaporization products of a consumable.

BACKGROUND

In view of developments in technology and the law, vaporization devices and nectar collectors have become quite popular. Often, to function, a vaporization device heats a consumable and/or inhalable product such as an oil, a wax, a concentrate, or a combustible plant substance to create a vapor for a user to inhale. Heating liquid or wax consumables has become particularly popular since liquids and waxes may be more concentrated and/or specialized as compared to plant substances and because a quantity of wax or liquid may last longer than a similar quantity of plant substance.

In typical nectar collectors, a tip of a rod is dipped in a consumable (e.g., oil, wax, a concentrate, a combustible plant substance, etc.) and is heated. The heat causes the consumable to vaporize into a vaporization product. Typically, the vaporization products of the consumable mix with a flow of air and pass through a heating element. The vaporization products may be burned when it contacts the heating element impacting the taste or effect of the vaporization products on the user. Further, the heating element may corrode from contact with the vaporization products and/or air, and thus, reduce the useful life of the heating element.

In view of at least the aforementioned issues, a vaporization device having an arrangement that overcomes the above noted issues is desirable.

SUMMARY

The present invention relates to a vaporization device that improves the life of a heating element and heating assembly powering and controlling the heating element by preventing a flow of fluid from contacting the heating assembly.

According to an example embodiment, a vaporization device includes a vaporization device having a pipe having an inlet and an outlet; a heating rod extending from a proximal end to a distal end and defining a fluid channel, the proximal end being configured to engage the inlet of the pipe, and the fluid channel extending through at least a portion of the heating rod; and a heating assembly including a coil concentric with at least an induction portion of the heating rod and one or more electrical components configured to deliver power to the coil so that the coil can heat the heating rod through induction heating.

In one form of the vaporization device, the heating assembly further including: a housing configured to support the power source, the pipe, and the heating rod.

According to another example embodiment, a method includes installing a heating rod in an inlet of a pipe; installing the heating rod and the pipe in an induction heating assembly having a coil such that at least a portion of the coil is concentric with the heating rod; conducting an electrical current through the coil; and inducing one or more currents in the heating rod via the electrical current conducted through the coil to Joule heat the heating rod.

In one form of the method, the method further includes contacting a consumable with the heated heating rod to generate vaporization products; and siphoning the vaporization products through the heating rod and the pipe.

In yet another example embodiment, a heating assembly for a vaporization device includes an induction coil configured to be concentric with at least a portion of a heating rod of a dip-style vaporization device; and one or more electrical components electrically coupled to the induction coil and configured to deliver power to the induction coil so that the induction coil can heat the heating rod through induction heating.

In one form of the a heating assembly, the heating assembly further includes a housing configured to support the one or more electrical components, a power source and a pipe.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

Figure 1:
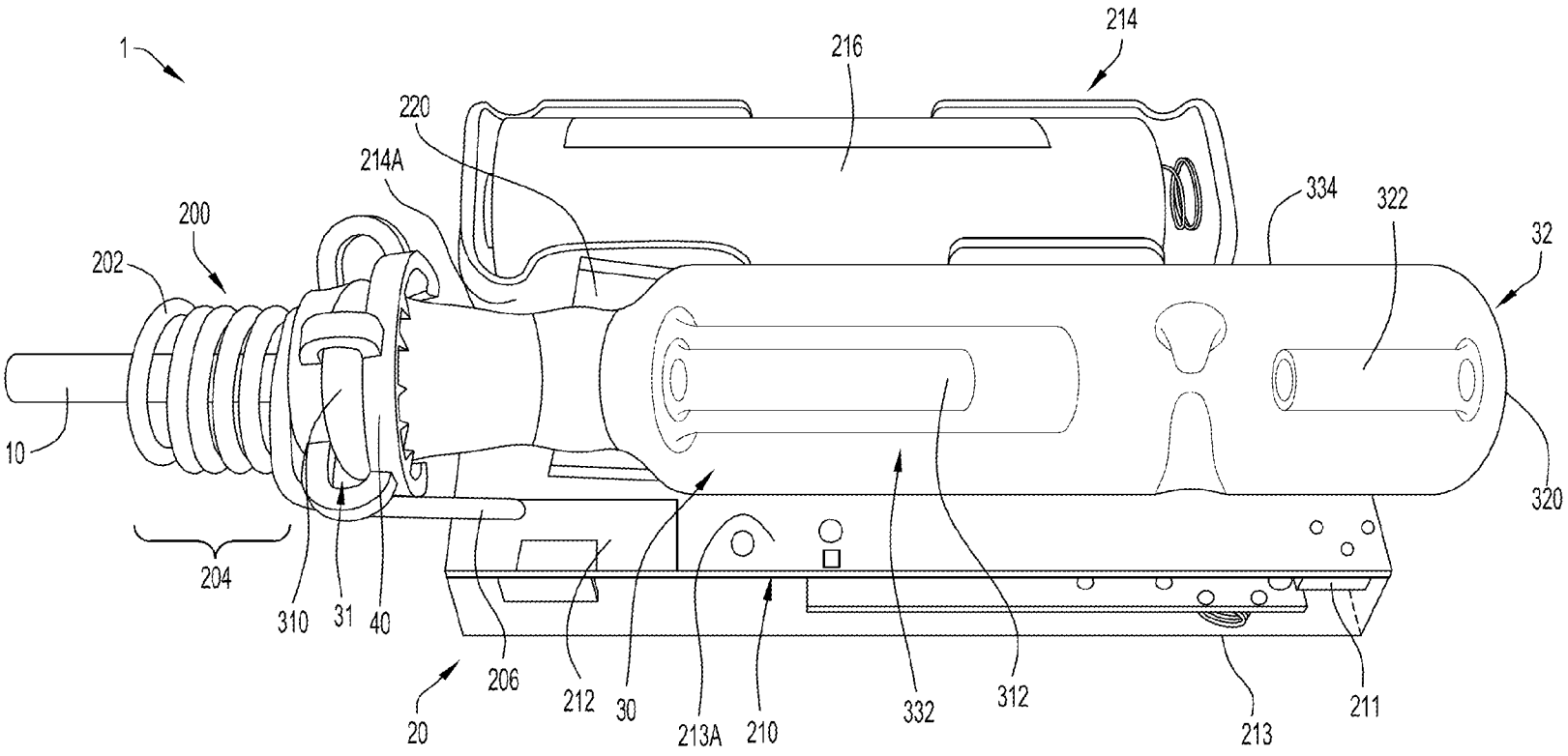
FIG. 1 is a perspective top view of a vaporization device, according to an embodiment.

The following description is not to be taken in a limiting sense but is given solely for the purpose of describing the broad principles of the invention. Embodiments of the invention will be described by way of example, with reference to the above-mentioned drawings showing elements and results according to the present invention.

Generally, a device and method for vaporizing a consumable as presented herein include a pipe, a nail or rod for contacting a consumable, and an induction heating assembly for heating the rod. During operation, the induction heating assembly heats the rod. The heated rod contacts the consumable, thereby heating and vaporizing the consumable. The vaporization products from the consumable are siphoned through the rod and/or pipe, avoiding the heating assembly (e.g., an induction coil and associated electronics) while flowing through the rod and/or pipe. That is, the heating assembly is separated from the flow of vapor product and air. Thus, the flow of vapor product and air bypasses the heating element (e.g., the induction coil). Consequently, the vapor products are not burned by the heating element while corrosion and material build-up of the induction coil is avoided.

Now referring to FIGS. 1-5, a vaporization device 1 (sometimes referred to a "Nectar Collector" device or system, dip-style vaporization device, dab device, etc.) is shown. The vaporization device 1 includes a heating rod, or nail, 10, an induction coil assembly or heating assembly 20, a pipe, or bubbler, 30, and a connector 40. As shown in FIGS. 1-5, the heating rod 10 is attached to the pipe 30, and further supported by the connector 40. The heating rod 10 and pipe 30 are received by the induction coil assembly 20. The induction coil assembly 20 is configured to induce one or more currents in the heating rod 10 thereby heating the heating rod 10 through Joule heating (sometimes called resistive heating, resistance heating, and/or Ohmic heating). Said another way, based on the Ohmic resistance of the heating rod 10, a temperature of the heating rod 10 increases in response to the one or more currents induced by the coil assembly 20. The connector 40 reinforces the connection between the heating rod 10 and pipe 30. In some implementations, the vaporization device 1 does not include a connector 40, and the pipe 30 fully supports the heating rod 10.

Figure 6B:
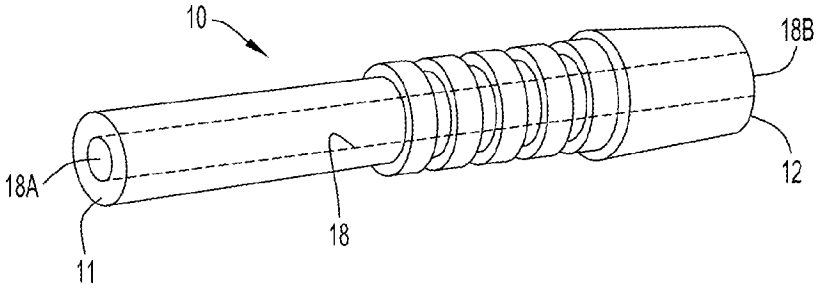
FIG. 6B is an upstream-side perspective view of the heating rod of FIG. 6A.
Figure 6A:
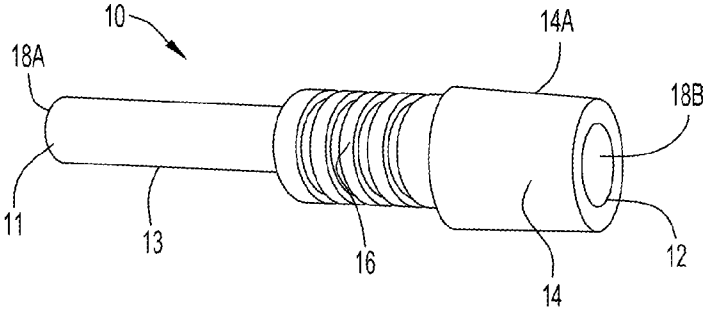
FIG. 6A is a downstream-side perspective view of a heating rod of the vaporization device of FIG. 1.

Now referring to FIGS. 6A and 6B, in at least some embodiments, the heating rod 10 includes a distal end 11 and a proximal end 12, a heating portion 13, an attachment portion 14, and an induction portion 16 between the heating portion 13 and the attachment portion 14. The induction portion 16 is configured to have one or more currents induced therein. That is, the induction coil assembly 20 induces one or more currents in the induction portion 16. The attachment portion 14 includes an outer surface 14A for engaging the pipe 30. The heating rod 10 further includes a fluid channel 18 extending from the distal end 11 to the proximal end 12. The fluid channel 18 includes a channel inlet 18A at the distal end 11 and a channel outlet 18B at the proximal end 12.

Referring back to FIGS. 1-5, the induction coil assembly 20 includes a coil 200 that is electrically and mechanically coupled to a controller 210. The coil 200 is made of a wire 202 having a plurality of turns, or windings, 204, and a plurality of ends 206 electrically coupled to the controller 210. For example, the coil 200 may be made of copper, aluminum, other low electrical resistance materials, alloys, or any combination thereof.

Figure 2:
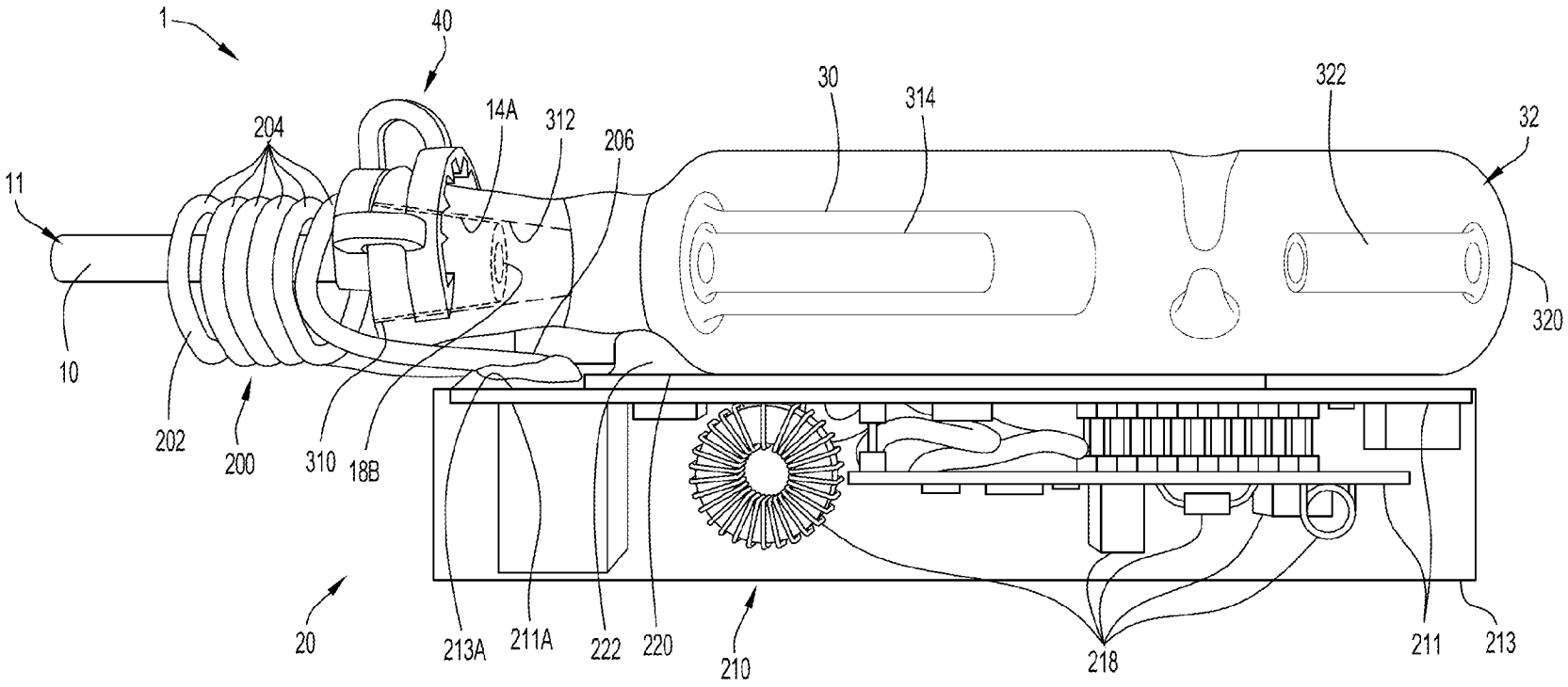
FIG. 2 is a front view of the vaporization device of FIG. 1.
Figure 3:
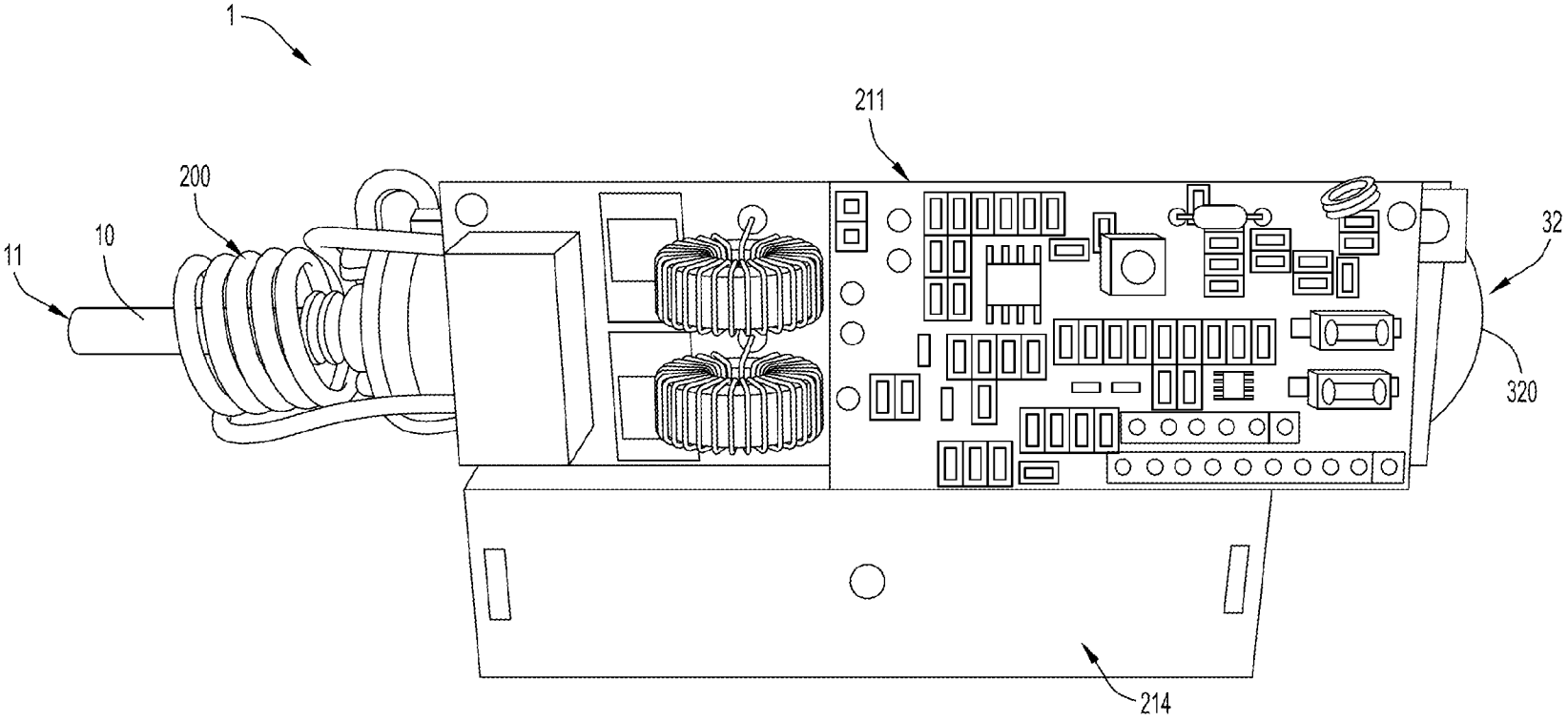
FIG. 3 is a bottom view of the vaporization device of FIG. 1.
Figure 4:
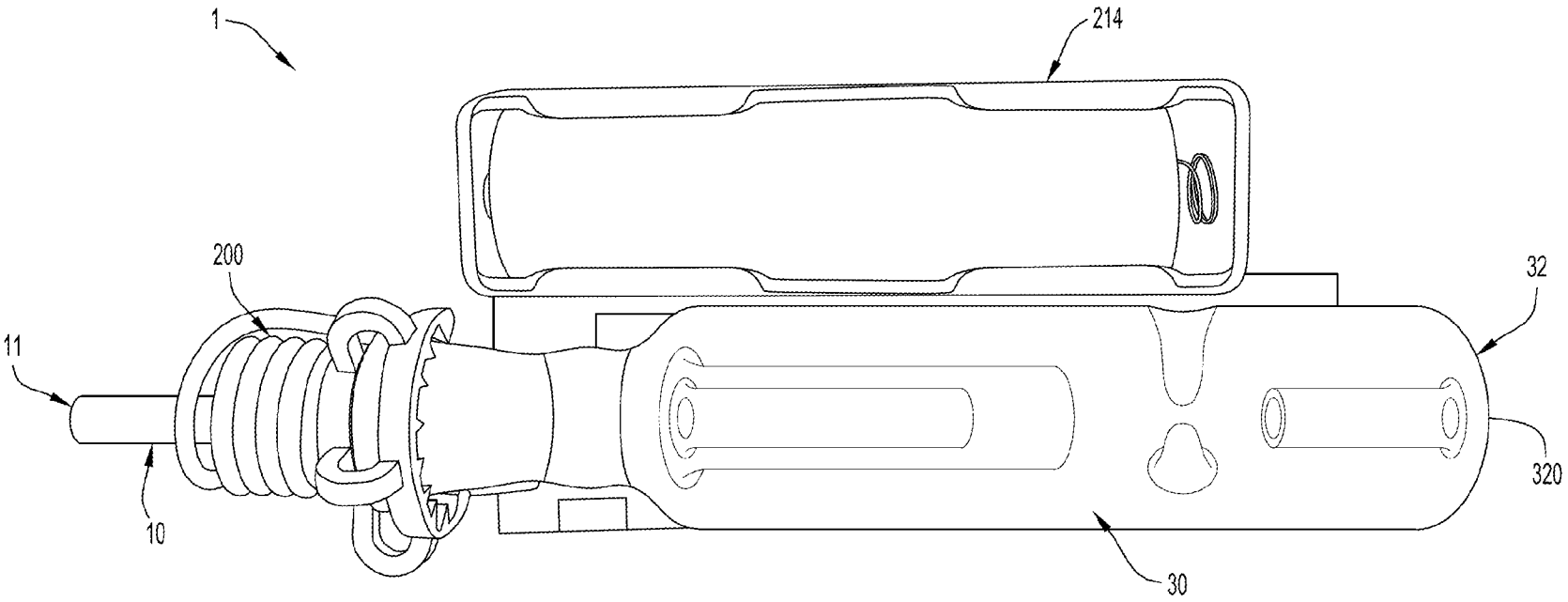
FIG. 4 is a top view of the vaporization device of FIG. 1.
Figure 5:
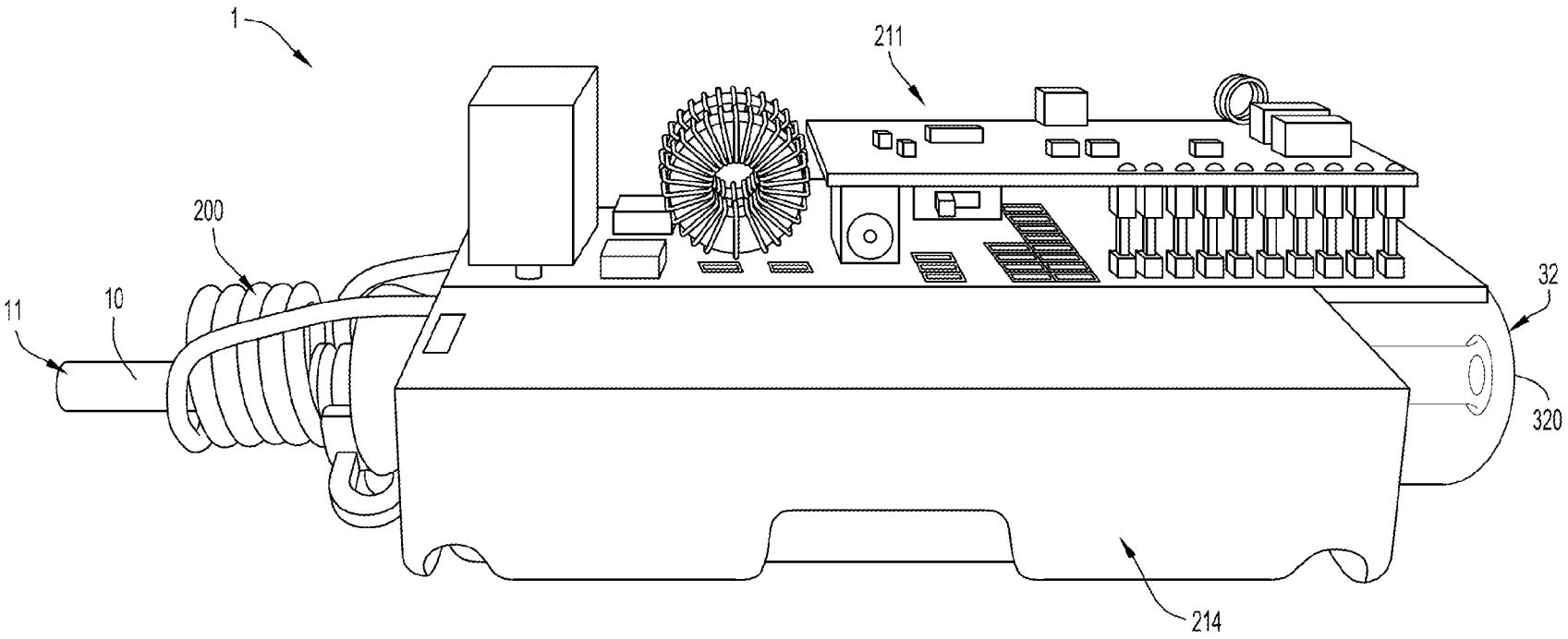
FIG. 5 is a rear view of the vaporization device of FIG. 1.

As best shown in FIGS. 1 and 2, in the depicted embodiment, the controller 210 includes one or more circuit boards 211 having a plurality of terminals 212, a controller housing 213 receiving the one or more circuit boards 211 (see FIG. 2), a power source housing 214, power source 216 received by the power source housing 214, and a plurality of electrical components 218 disposed on the one or more circuit boards 211 for controlling a flow of current through the coil 200. The terminals 212 contact the ends 206 of the coil 200 and electrically couple the coil 200 to the controller 210. The power source housing 214 includes an outer surface 214A that is substantially perpendicular to a contact surface 213A of the controller housing 213.

However, embodiments are not limited to the depicted embodiment. In some implementations, an angle between the outer surface 214A and the contact surface 213A ranges from 20 degrees to 160 degrees. In some implementations, the controller housing 213 and power source housing 214 are portions of a unitary structure. Said another way, the controller housing 213 and power source housing 214 may be combined to define a single housing for receiving the one or more circuit boards 211, the electrical components 218, and the power source 216 as well as supporting the pipe 30 and the heating rod 10. The power source 216 may be a battery, or a socket for receiving power from an external source removably coupleable to the induction coil assembly 20. In some implementations, the one or more circuit boards 211 and plurality of electrical components may be replaced with one or more processors, printed circuit boards, semiconductors, substrates, and/or application specific integrated circuits configured to control the induction coil 200 and heating of the heating rod 10.

As depicted in FIGS. 1 and 2, in the depicted embodiment, the vaporization device 1 further includes a cradle 220 for receiving and aligning the pipe 30 with the induction coil 200. The cradle 220 is disposed on the contact surface 213A of the housing 213 and the outer surface 214A of the power source housing 214. That is, the cradle 220 conforms to the angle between the contact surface 213A and outer surface 214A. The cradle 220 comprises a friction mat having a grip surface 222 with a high coefficient of friction for gripping the pipe 30. In some implementations, the cradle 220 comprises a coating having a high coefficient of friction applied to the controller housing 213 and/or the power source housing 214. In some implementations, the vaporization device 1 may not have a cradle 220, and the controller housing and/or power source housing 214 are configured to support the pipe 30. Regardless of whether the vaporization device 1 includes the cradle 220, ultimately the controller housing 213 and/or the power source housing 214 receives and aligns the pipe 30 with the induction coil 200.

The pipe 30 is substantially cylindrical and includes an upstream or distal end 31 and a downstream or proximal end 32. The pipe 30 further includes an inlet 310 at the distal end 31, an outlet 320 at the proximal end 32, and a cylindrical wall 330 extending between the distal end 31 and proximal end 32. The inlet 310 has a frustoconical shape defined by an inlet surface 312. As best shown in FIG. 2, the inlet surface 312 is configured to engage the attachment surface 14A of the heating rod 10. That is, the heating rod 10 is supported and attached to the pipe 30 via a friction fit between the inlet surface 312 of the pipe inlet 310 and the outer surface 14A of the attachment portion 14 of the heating rod 10. However, in other embodiments, the pipe 30 may have any shape or size, may be made of any desired material, and/or may be connected to or supported by housing 213 and/or housing 214 in any manner. In fact, in some embodiments, the pipe 30 may be a straw-shaped pipe that extends alongside and/or wraps around housing 213 and/or housing 214.

That all said, as best shown in FIG. 1, in the depicted embodiment, the cylindrical wall 330 defines chamber or cavity 332 fluidly coupled to the inlet 310 and outlet 320. The outlet 320 may be used as a mouthpiece to be received by the user's mouth. The cylindrical wall 330 further contacts an outer surface of at least one of the controller housing 213 and the power source housing 214. In some implementations, a cradle 220 is disposed between the pipe 30 and the at least one of the housings 213, 214 to grip a portion the cylindrical wall 330. That is, the cradle 220 engages a portion an outer surface 334 of the cylindrical wall 330. For example, the cradle 220 may grip the pipe 30 by engaging first and second portions of the outer surface 334. The second portion may be oblique or perpendicular to the first portion of the outer surface 334. However, embodiments are not limited thereto, and at least one of the controller housing 213 and power source housing 214 (or a unitary housing defining a controller housing and a power source housing) may engage and support the pipe 30.

In the embodiment shown, the pipe 30 is a glass bubbler and further includes an inlet stem extending 314 from the inlet 310 into the cavity 332 and an outlet stem 322 extending upstream from the outlet 320 into the cavity 332. During use, the cavity 332 may be partially filled with water such that an outlet of the inlet stems 314 is below the water. Thus, when a suction is applied to the pipe 30, air and/or vapor products flows into the pipe 30 through the inlet 310, through the inlet stem 314, through the water the cavity 332, and out through the outlet stem 322 to the outlet 320. To reiterate, although a glass bubbler is shown in FIGS. 1-5 and 7, embodiments are not limited thereto. The pipe 30 may be any structure having any shape with an internal channel capable of guiding a flow of fluid emanating from the heating rod 10. Further, the pipe 30 may be made of any material capable of withstanding the temperatures of the connected the heating rod 10, e.g., high-temperature plastics, glass, non-conductive composite material, silicone, quartz, metal, etc. In some implementations, the pipe 30 is part of the induction coil assembly 20. That is, the pipe 30 may be integrally formed with the controller housing 213 but fluidly separated from electrical control elements and the coil 200 of the induction coil assembly 20.

Figure 7:
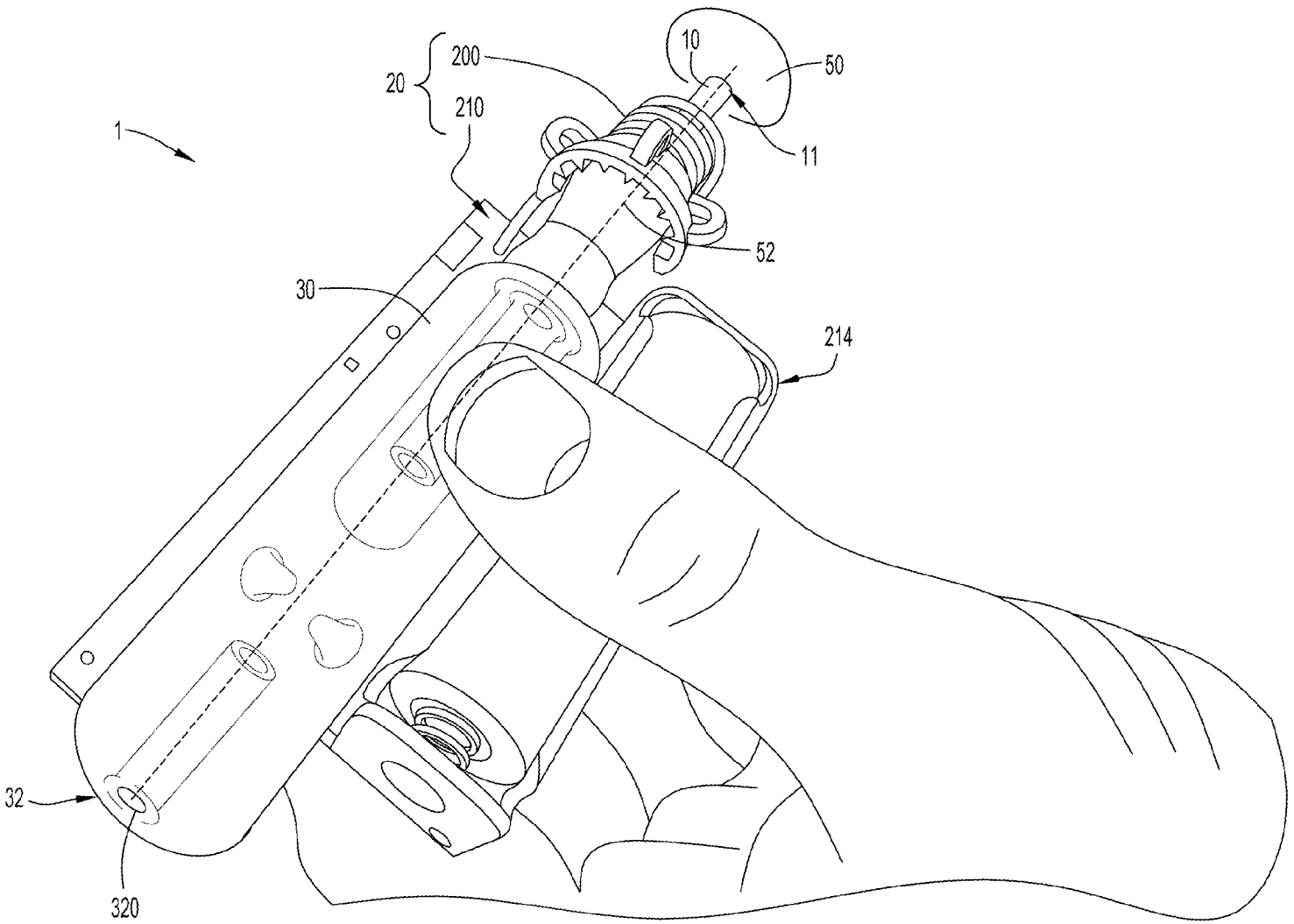
FIG. 7 is a perspective view of vaporization device of FIG. 1 during operation.

Now referring to FIG. 7, operation of the vaporization device 1 is depicted with the heating rod 10 and pipe 30 assembled. Generally, these parts are assembled by coupling the attachment portion 14 of the heating rod 10 to the inlet 310 of the pipe 30. Additionally, in at least some embodiments (e.g., the depicted embodiment), the outer surface 14A of the attachment portion 14 frictionally engages the inlet surface 312 of the inlet 310. In some implementations, a connector 40 may be coupled to the pipe 30 and the heating rod 10 to reinforce the interference or friction fit between the attachment portion 14 and the inlet 310. Once the heating rod 10 and pipe 30 are assembled, the rod 10 and pipe 30 assembly is disposed or installed in the induction coil assembly 20 such that at least a portion of the heating rod 10 is concentric with at least a portion of the coil 200. Or, from another perspective, the coil assembly 20 will encircle the heating rod 10. However, the order of assembly of the vaporization device 1 may be varied. For example, the coil 200 may be concentrically aligned with a portion of the heating rod 10 prior to attaching the pipe 30; the pipe 30 may be aligned with coil 200 prior to attaching the heating rod 10; or the heating rod 10, coil 200, and pipe may be simultaneously aligned and attached. Regardless of the order of assembly, once the rod 10, induction coil assembly 20, and pipe 30 are assembled, the vaporization device 1 is ready for operation.

During operation, a user may toggle a switch, button, or other user interface to heat the heating rod 10. Supply current from the power source 216 (e.g., direct current) is transformed or converted into a high-frequency, alternating current and delivered or transmitted to the induction coil 200 via the electrical components 218. The high-frequency, alternating current is conducted through induction coil 200 surrounding the induction portion 16 of the heating rod 10. The high-frequency, alternating current in the coil 200 induces one or more currents in the induction portion 16 of the heating rod 10. The induced one or more currents cause the induction portion 16 to heat due to the Ohmic resistance of the material of the heating rod 10. That is, the heating rod 10 is Joule heated in response to the high-frequency, alternating current flowing through the coil 200. The heat is conducted through the induction portion 16 to the heating portion 13. Once the heating portion 13 is heated to a desired temperature, the distal end 11 of the heating rod 10 contacts and heats a consumable 50 to be vaporized. Vaporization products 52 of the heated consumable 50 (and air) are siphoned into the channel inlet 18A and through the channel 18 of the heating rod 10, through the pipe inlet 310 and into the chamber 332. The vaporization products 52 are siphoned from the chamber 332 through the outlet 320 of the pipe 30.

A user may create suction for siphoning the vaporization products 52 through the vaporization device 1 by placing their mouth on the outlet 320 at the proximal end 32 of the pipe 30 and inhaling. The vaporization products 52 may be inhaled by a user.

Accordingly, the vaporization products travel through one or more internal channels of the vaporization device 1 without contacting the coil 200 (or electrical components 218 which control the coil 200) which heats the rod 10. Consequently, the vapor products 52 are not burned by the heating element (e.g., coil 200) and corrosion and/or material build-up of the heating assembly 20 are avoided.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the vaporization device 1 described herein, or portions thereof, may be fabricated from any suitable material or combination of materials, such as plastic, foamed plastic, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above", "below", "upper", "lower", "top", "bottom", "left," "right," "front," "rear," "side," "height," "length," "width," "interior," "exterior," "inner," "outer" or other similar terms merely describe points of reference and do not limit the present invention to any particular orientation or configuration. When used to describe a range of dimensions and/or other characteristics (e.g., time, pressure, temperature, distance, etc.) of an element, operations, conditions, etc. the phrase "between X and Y" represents a range that includes X and Y.

Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity, and does not in itself dictate a relationship between the various embodiments and/or configurations discussed.

When used herein, the term "comprises" and its derivations (such as "comprising", "including," "containing," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the similar terms, such as, but not limited to, "about," "around," and "substantially."

As used herein, unless expressly stated to the contrary, use of the phrase "at least one of", "one or more of", "and/or", and variations thereof are open-ended expressions that are both conjunctive and disjunctive in operation for any and all possible combination of the associated listed items. For example, each of the expressions "at least one of X, Y and Z", "at least one of X, Y or Z", "one or more of X, Y and Z", "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z. Further as referred to herein, "at least one of" and "one or more of" can be represented using the "(s)" nomenclature (e.g., one or more element(s)).

Additionally, unless expressly stated to the contrary, the terms "first", "second", "third", etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements.

The invention claimed is:

1. A vaporization device comprising:

a pipe having an inlet and an outlet;

a heating rod extending from a proximal end to a distal end, the proximal end being configured to engage the inlet of the pipe, wherein the heating rod and the pipe define a fluid channel, the fluid channel extending from the distal end of the heating rod to the outlet of the pipe; and a heating assembly comprising a coil concentric with at least an induction portion of the heating rod and one or more electrical components configured to deliver power to the coil so that the coil can heat the heating rod through induction heating.

2. The vaporization device of claim 1, wherein the heating assembly further comprises:

a circuit board on which the one or more electrical components are disposed.

3. The vaporization device of claim 1, wherein the heating assembly further comprises:

a power source configured to supply power to the one or more electrical components, the power source being removably coupleable to the heating assembly.

4. The vaporization device of claim 3, wherein the heating assembly further comprising:

a housing configured to support the power source, the pipe, and the heating rod.

5. The vaporization device of claim 4, wherein the housing comprises a cradle configured to removably support the pipe.

6. The vaporization device of claim 5, wherein the cradle comprises a friction mat having a high coefficient of friction; and the cradle contacts a first portion of the pipe and a second portion of the pipe, wherein the second portion is oblique or perpendicular to the first portion.

7. The vaporization device of claim 1, wherein the pipe comprises a glass pipe, a bubbler, a heat-resistant plastic pipe, a non-conductive composite pipe, a straw, or a combination of two or more thereof.

8. The vaporization device of claim 1, further comprising a connector configured to reinforce a connection between the heating rod and the pipe.

9. A method, comprising:

installing a heating rod in an inlet of a pipe;

installing the heating rod and the pipe in an induction heating assembly having a coil such that at least a portion of the coil is concentric with the heating rod;

conducting an electrical current through the coil;

inducing one or more currents in the heating rod via the electrical current conducted through the coil to Joule heat the heating rod;

contacting a consumable with the heated heating rod to generate vaporization products; and siphoning the vaporization products from a distal end of the heating rod, through the heating rod and the pipe, to a pipe outlet.

10. The method of claim 9, wherein the electrical current conducted through the coil is a high-frequency alternating current.

11. The method of claim 10, further comprising converting, via the induction heating assembly, a supply current from a power source into the high-frequency alternating current.

12. The method of claim 11, wherein the supply current is a direct current; and the power source is a battery electrically coupled to the induction heating assembly.

13. The method of claim 9, wherein the one or more currents are induced in at least an induction portion of the heating rod to Joule heat at least the induction portion.

14. The method of claim 13, further comprising conducting heat from at least the induction portion to a heating portion of the heating rod.

15. A heating assembly for a vaporization device comprising:

a heating rod having a fluid channel extending from a distal end of the heating rod;

a pipe having an outlet at a proximal end of the pipe, wherein the pipe is fluidly coupled to the fluid channel of the heating rod and the pipe and the heating rod are configured to guide fluid from the distal end of the heating rod to the outlet of the pipe;

an induction coil configured to be concentric with at least a portion of the heating rod of a dip-style vaporization device; and one or more electrical components electrically coupled to the induction coil and configured to deliver power to the induction coil so that the induction coil can heat the heating rod through induction heating.

16. The heating assembly of claim 15, wherein the heating assembly further comprises:

a circuit board on which the one or more electrical components are disposed.

17. The heating assembly of claim 15, further comprising: a housing configured to support the one or more electrical components, a power source and the pipe.

18. The heating assembly of claim 17, further comprising a cradle disposed on the housing, wherein the cradle comprises a surface with a high coefficient of friction.

19. The heating assembly of claim 15, wherein the one or more electrical components are configured to convert power from a power source into a high-frequency alternating current and transmit the high-frequency alternating current through the induction coil.

20. The vaporization device of claim 1, further comprising a housing for one or more electrical components, wherein an exterior of the housing is configured to support at least a portion of the pipe.

* * * * *